United States Patent [19]

Sigott et al.

[11] 4,111,488

[45] Sep. 5, 1978

[54] METHOD FOR CUTTING MINERALS AND CUTTING MACHINE

[75] Inventors: Siegfried Sigott; Alfred Zitz; Herwig Wrulich, all of Zeltweg, Austria

[73] Assignee: Vereinigte Osterreichische Eisen- und Stahlwerke - Alpine Montan Aktiengesellschaft, Vienna, Austria

[21] Appl. No.: 719,654

[22] Filed: Sep. 1, 1976

[30] Foreign Application Priority Data

Sep. 3, 1975 [AT] Austria ..... 6796/75

[51] Int. Cl.[2] ..... E21C 27/24

[52] U.S. Cl. ..... 299/10; 299/75

[58] Field of Search ..... 299/1, 75, 10

[56] References Cited

U.S. PATENT DOCUMENTS

| | | | |
|---|---|---|---|
| 1,797,024 | 3/1931 | Degenhardt et al. | 299/1 |
| 2,136,921 | 11/1938 | Joy | 299/1 |
| 3,302,974 | 2/1967 | Hlinsky | 299/75 X |
| 3,353,871 | 11/1967 | Arentzen | 299/75 X |

FOREIGN PATENT DOCUMENTS

| | | | |
|---|---|---|---|
| 373,410 | 12/1973 | U.S.S.R. | 299/75 |

*Primary Examiner*—Ernest R. Purser

*Attorney, Agent, or Firm*—Cushman, Darby & Cushman

[57] ABSTRACT

In a method and apparatus for cutting minerals utilizing a cutting tool provided with cutting teeth, the tool rotates about an axis approximately parallel to the winning face and is moved at a feeding rate essentially in axial direction. Several grooves spaced from each other are carved in sequence, and in dependence on the mineral properties the feeding rate is increased with respect to the rotatory velocity when a brittle mineral is to be cut, while the feeding rate is diminished with a tough mineral.

11 Claims, 7 Drawing Figures

C
a
118
118
106

C
a
118
106

METHOD FOR CUTTING MINERALS AND CUTTING MACHINE

The invention relates to a method for cutting trenches into mineral, by applying a cutting tool means provided with cutting teeth and rotatable about an axis approximately parallel to the winning face, said cutting tool means being moved about in axial direction at a certain feed rate. Further, the invention relates to a cutting machine for carrying out the aforesaid method.

When cutting with a cutting tool means fed in axial direction, each of the cutting teeth carves a helicoidal groove into the mineral. Since the cutting tool means is moved forward only up to its axis and therefore does not cut around its whole surface, said grooves extend but over a segment of a helicoidal line. With this method, it is prior art to guide the subsequent cutting teeth in such a manner that each tooth enters the groove made by the antecedent tooth and deepens this groove. This procedure is possible only provided a fixed relation is determined between the number of revolutions and the rate of axial feed of the cutting tool means. Should this relation alter, the position of the following grooves differs from that of the first carved grooves, i.e., the following cutting tooth does not enter the groove its predecessor has cut, in that way, the stress in the different cutting teeth is altered, and one tooth is insufficiently employed, whilst the other is overloaded. Breakings may be the consequence. That is the reason why it has been impossible up to now to vary in a cutting machine the relation between rotation and axial feed, and no machine structure allowing such variation was known till now.

The present invention is essentially characterized in that with a cutting method wherein the cutting tool means is axially fed in a direction parallel to the winning face several grooves distant from each other are carved after each other in engaging sequence and that in dependence on the mineral properties the feeding rate is increased with respect to the rotatory velocity when a brittle mineral is to be cut whilst the feeding rate is diminished with a tough mineral.

By carving the grooves one after another in a distance from each other according to the cutting sequence each cutting tooth follows its own way. If the relation between the feed rate and the rotation speed is altered nothing is changed but the distance between the grooves, the tooth load remaining unaltered (or altered within acceptable limits).

By varying the relation between the feed rate and the rotation speed one may take into account to a considerably high degree the characteristic features of the mineral to be cut. If with a brittle mineral the aforementioned proportion is increased, the distances of the grooves turn out greater. The ribs remaining between the grooves are broken out and the power necessary for breaking out the ribs is smaller than the power needed for cutting the grooves. The more brittle the mineral, the greater the possible proportion of the broken material with relation to the cut-out material. Thus the output rate as to quantity can be considerably increased without increasing the input energy.

When selecting a smaller proportion between feed rate and rotative speed the distances between the grooves carved into the mineral become narrower and the percentage of the mineral to be broken out is smaller. Consequently, with a tough mineral it is necessary to diminish the abovementioned proportion.

But now, the hardness of the mineral may be different, with a tough mineral as well as with a brittle one. The softer the mineral, the greater the rotative speed of the cutting tool means can be selected without running the risk of overloading the teeth. Thus, according to the invention, the rotative speed of the cutting tool is to be diminished with hard minerals and increased with soft minerals.

Thus the invention gives the possibility to utilize fully the chargeability of the cutting teeth, whether with a brittle mineral or with a tough one, and with various hardnesses of these minerals. At all events, the optimum cutting performance, i.e. the greatest possible volume output is achievable without any risk of overloading the cutting teeth or the drive means.

The process according to the invention consists in that a groove is cut upon the engaging sequence between two grooves previously cut out. This facilitates breaking the mineral since the borders of the intermediate groove have no support owing to the adjacent grooves.

Upon another advantageous modification of the inventive method two grooves distant from each other are cut out first; then in the engaging sequence follows a third groove positioned about in the middle between the first ones; and thirdly two additional grooves are cut between said three grooves previously cut out. So the percentage to be broken out is further increased.

A cutting machine operating according to the invention has a jib arm with at least one cutting tool means rotatable about an axis perpendicular to the center line of said jib arm. A hydraulic cylinder and piston unit is provided to drive said jib arm in its pivoting movement in the direction of the cutting tool axis.

Upon the invention the cross-section of the conduit for the hydraulic pressure medium feeding said cylinder and piston unit can be dimensioned at least for the greatest allowable pivoting velocity, and the conduit may be provided with a regulable reducing valve. But preferably the invention provides a separate pump having variable capacity. This eliminates the inconvenience that the pressure medium is heated up when being throttled in a reducing valve. Such a pump may be preferably a swash cylinder pump, also called pivotable axial piston pump which allows to vary its capacity by pivoting the cylinder(s) with relation to the piston(s). So it is easy to regulate the swivelling velocity of the jib arm and, thereby, the feed velocity of the cutting tool means. In the machine according to the invention there may be provided a variable transmission means between the driving motor and the cutting tool means in order to make the rotative speed regulable. Such a variable transmission means may be a hydraulic torque converter or a gear box with change wheels.

In the drawing the invention is illustrated by way of example.

Figure 7:
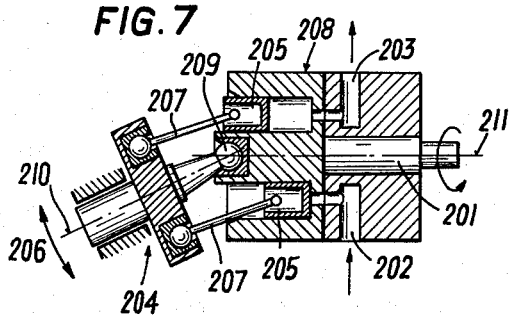
Figure 4:
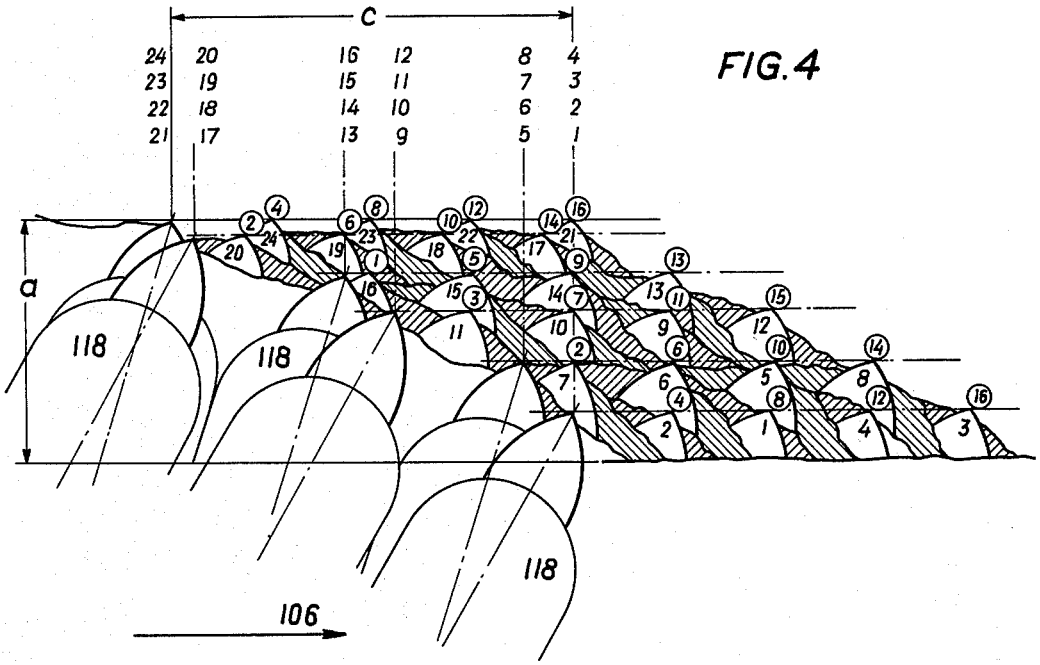
Figure 5:
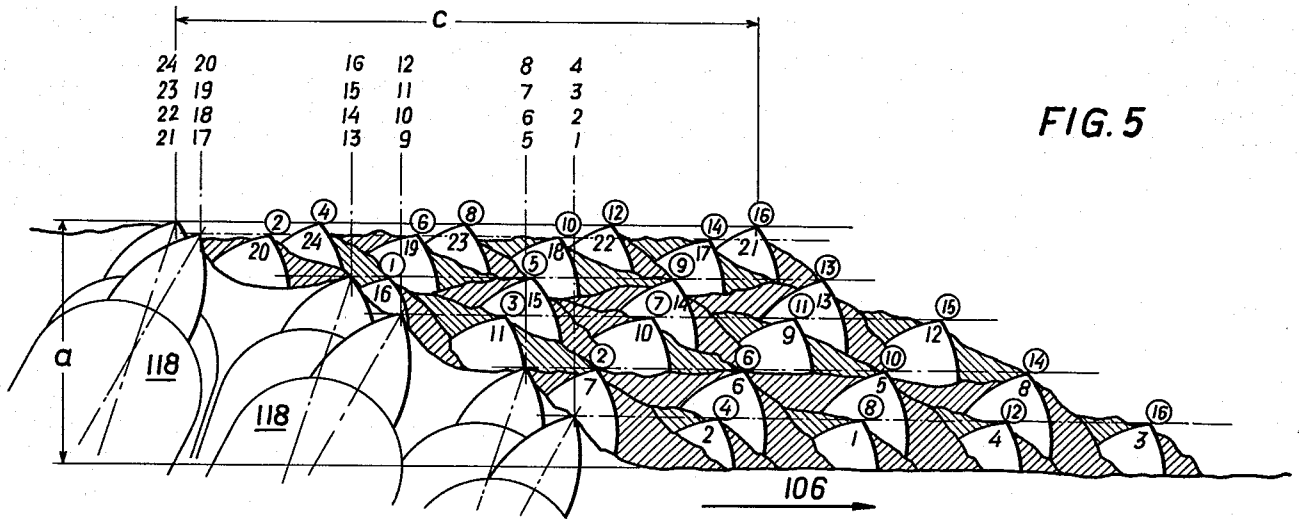
Figure 6:
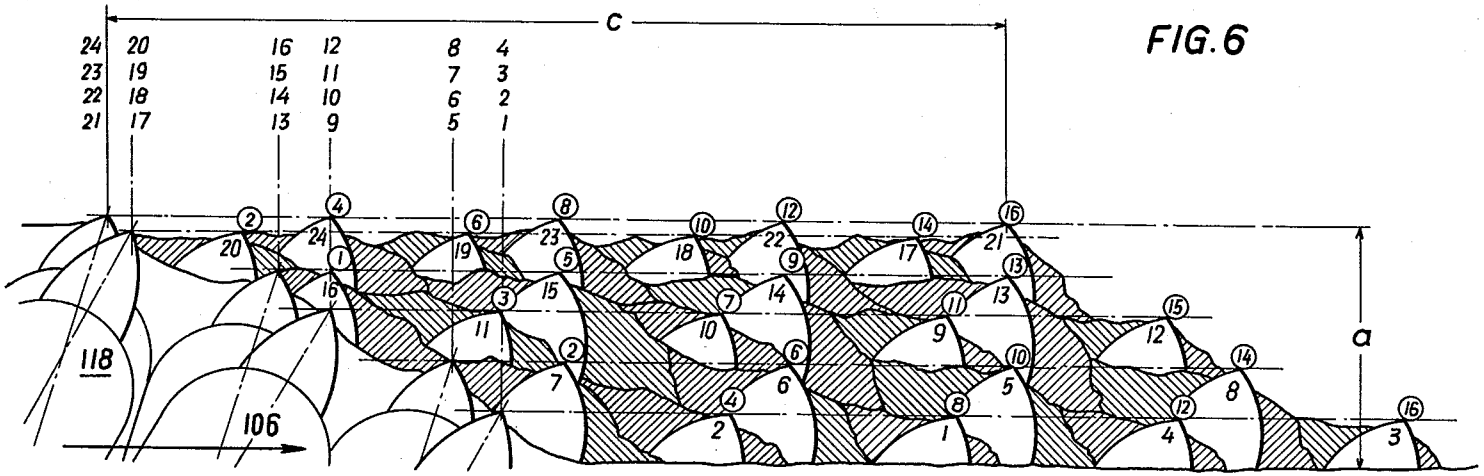

FIGS. 4, 5, and 6 show schematically the so-called engaging figures of the cutting teeth, and FIG. 7 is a cross-sectional view of an axial piston pump supplying the pressure medium for the jib moving cylinder.

Figure 1:
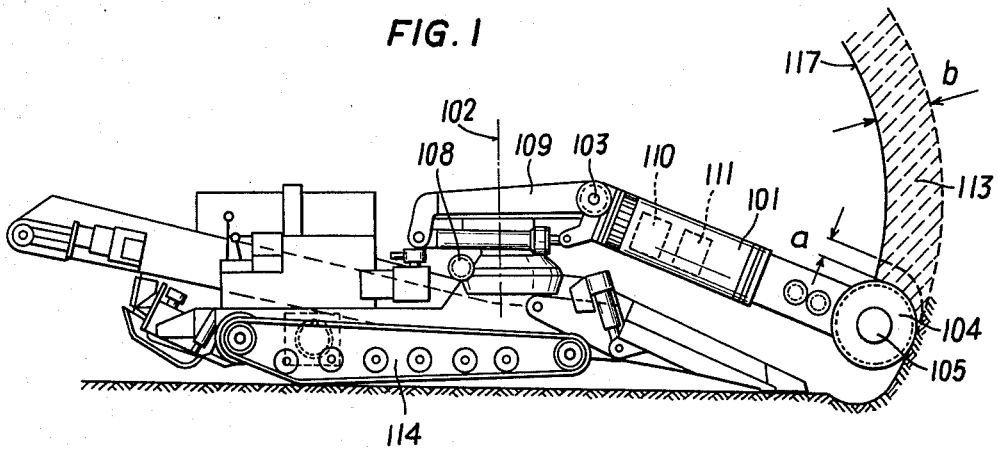
FIGS. 1 and 2 show a cutting machine in its operative position in elevation view and in plan view, respectively.
Figure 2:
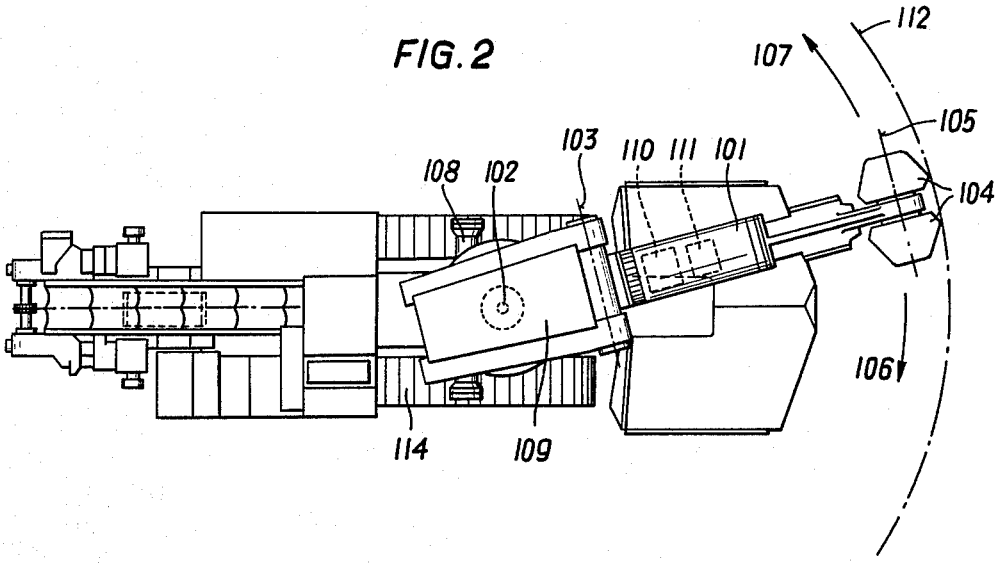

The cutting machine as shown in FIGS. 1 and 2 has a jib arm 101 pivotable about a vertical axis 102 and a horizontal axis 103 which allows an all-directional swivelling 104 is a double cutting tool means rotatable about an axis 105. Since the jib arm 101 is pivotable about the axis 102 its feeding way is arcuated, the rotational axis 105 extending in tangential direction. According as the right hand or the left hand cutting tool means is working, the feed movement follows the arrow 106 or 107.

A hydraulic cylinder indicated at 108 is actuating a rack cooperating with a toothed wheel secured on a block 109. The diameter of the oil supply conduit supplying the cylinder 108 is designed to enable the greatest needed velocity of pivoting. If, by way of example, a controllable reducing valve is inserted in said oil supply conduit, it is possible to draw the pressure medium from the oil system of the cutting machine. However, a reducing valve causes heating up the pressure medium. This is a disadvantage particularly after a long period of operation. Therefore, it is preferred to provide a separate oil pump for supplying the cylinder 108 with pressure medium. Such pump should have a variable capacity like a pivotable axial piston pump. A pump of this kind comprises a rotatable shaft 210 having a crosshead 204 with one piston or several pistons 205 hinged thereon excentrically with relation to said shaft. The working cylinders are disposed within a section 208 rotatable with the shaft and pivotable with relation to the shaft about an axis 211 crossing said shaft. The feed rate of the pump varies in dependence upon the deflection of said section containing the cylinders. The feed rate increases when the angle between the shaft 206 and the axis 211 of the cylinder of the section 208 is increased, and vice versa. Thus it is possible to vary the swivelling velocity of the jib arm 101 and consequently the feed velocity of the cutting tool means 104 in its axial direction. The jib arm 101 contains a motor 110 driving the cutting tool means 104 and a gear 111. The transmission ratio can be varied so that also the rotating speed of the cutting tool means is variable. Thus the feed velocity as well as the rotation velocity can be selected at choice within certain limits, what means that the relation between these two velocities is changeable.

The cutting tool means 104 works in the direction of its axis 105 alternatively to the right and to the left following the arrows 106 and 107, respectively. It moves along a circular arc 112, carving each time a horizontal trench. When the horizontal movement ends, the jib arm 101 is heightened by turning about the axis 103 whereby the cutting tool means 104 is lifted by the amount *a* which we denominate "total depth of cut". In this position, the cutting tool means cuts into the solid. The hatched zone 113 in the drawing indicates the depth of cut *b* carved out line by line with the cutting machine standing in one position, the width of each line being defined by the total depth *a*. After having cut out one zone 113, the machine is advanced by the distance *b* by means of the caterpillar truck 114.

Figure 3:
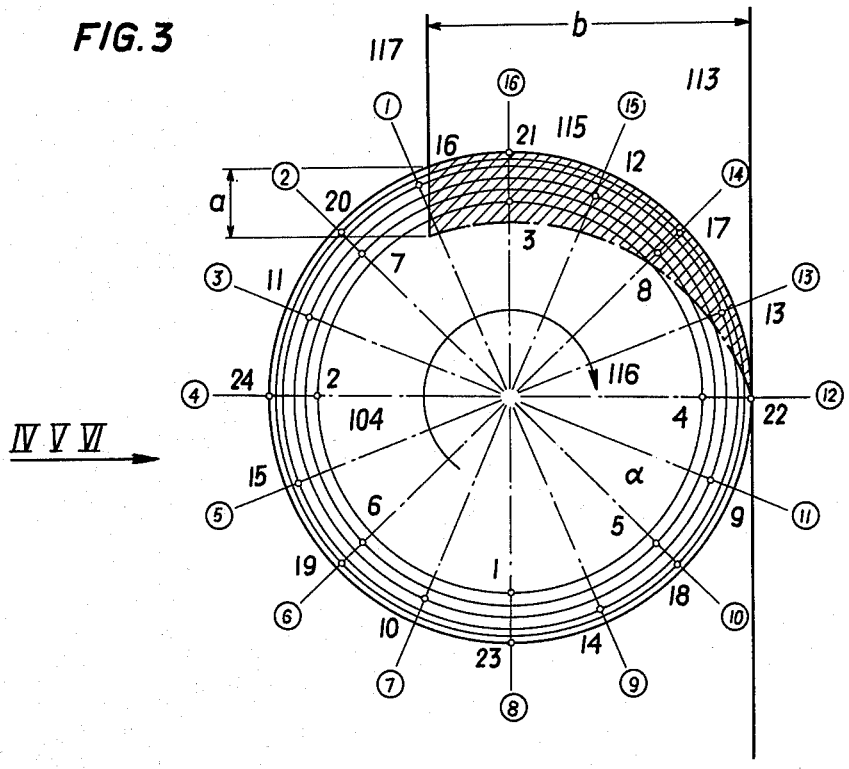
FIG. 3 shows schematically a cutting tool means.

FIG. 3 shows at a larger scale the circumference of the cutting tool means 104. The sense of rotation is indicated by the arrow 116. Again the total depth is indicated by *a*. The distance *b* is the depth of the zone 113 worked out from the actual position of the machine. The hatched zone 115 corresponds to the total depth of cut (*a*) which is cut out along one working line. In the example shown the cutting tool means has 24 cutting teeth. The tooth points are designated with numbers from 1 through 24. The teeth engage the winning face 117 one after another The teeth are positioned in 16 radial planes designated in the drawing by encircled numbers 1 through 16. The angle enclosed between two adjacent planes is 22½°. The teeth distributed in these radial planes engage one after another the winning face 117 in the sequence defined by the encircled numbers.

FIGS. 4, 5 and 6 show the so-called engaging figures of the cutting teeth. The relative position of the teeth is repeated after every 90°, so the teeth are equally distributed over the four quadrants. In FIGS. 4 and 5 all teeth 118 are shown as turned into the drawing plane. Again the points are designated by 1 to 24, and the total depth of cut by *a*. During each revolution the cutting tool means 104 is advanced in the direction of the arrow 106 by a certain feed way *c*. Thus, after one revolution, each tooth point from 1 to 24 gets onward by the distance *c* to the right. In the so-called engaging figures as in FIGS. 4, 5 and 6 it is shown how the tooth points are advanced to the right during the operating motion. The points are numbered from 1 to 24 as in FIG. 3, whilst the engaging sequence is defined by the encircled cyphers 1 to 16.

The cutting teeth do not only cut, but they break the mineral since their working ways are distant from each other. The supposed breaking lines are marked in the drawings, the broken cross-sections being indicated by hatching lines extending in different directions.

The engaging figures resulting from different feed rates at a constant rotation speed are represented in FIGS. 4, 5, and 6. These figures are seen in the direction of the arrow IV/V/VI of FIG. 3. FIG. 4 corresponds to the lowest feed rate, FIG. 5 to a middle — and FIG. 6 to the highest feed rate, all of them with relation to a constant rotatory speed of the cutting tool means. Therefore, the length of the distance *c* corresponding to one revolution is short in FIG. 4, longer in FIG. 5 and still longer in FIG. 6.

It is to be seen from the FIGS. 4–6 that the tooth surface portion which engages the mineral varies depending on the feed rate of the cutting tool means. The shorter the distance *c*, the smaller the engaged tooth surface. Within one of the FIGS. 4, or 5, or 6, i.e. within one constant feed rate, the working surface portion is essentially the same on all teeth of the tool means. A difference is designed only on the teeth visible at the left hand side where the cutting work begins from. When continuing the engaging figures over the first distance *c*, the engaged surface portion remains essentially the same.

A smaller distance *c*, i.e. lower value of the proportion between feed rate and rotatory speed as shown in FIG. 4 will be elected for less brittle minerals which are, in case, of greater hardness whilst an increased *c*, as in FIG. 6 will be preferred with a more brittle mineral which is occasion arises may be softer. Thus a greater output can be achieved with a brittle and soft mineral in comparison with a harder and not so brittle mineral.

What we claim is:

1. A method for cutting minerals from a winning face utilizing a circular cutting tool means provided with cutting teeth positioned in radial planes, said tool means rotating about an axis approximately parallel to the winning face and being moved at a feeding rate essentially in axial direction, said method characterized in that several grooves spaced-apart from each other are carved one after another in engaging sequence and that in dependence on the mineral properties the feeding rate is increased with respect to the rotary velocity when a brittle mineral is to be cut and is diminished with respect to the rotary velocity when a tough mineral is to be cut.

2. The method as in claim 1, characterized in that the rotative speed of the cutting tool means is diminished when cutting a hard mineral and is increased when cutting a soft mineral.

3. The method as in claim 1, characterized in that in conformity with the engaging sequence a groove is carved out between two previously-cut spaced-apart grooves.

4. The method according to claim 1, characterized in that two grooves spaced apart from each other are cut out first, then a third groove is cut out about in the middle between the first ones, and subsequently two grooves are cut between said third groove and said two first grooves.

5. A cutting machine for cutting minerals from a winning face comprising a machine frame provided with a jib arm having inner and outer ends and at least one circular cutting tool means having cutting teeth positioned in radial planes, said tool means rotatably journalled on the outer end of the jib arm, the rotation axis of the tool means extending perpendicularly to the center line of said jib arm, means mounting the inner end of the jib arm to the machine frame for pivotable movement of the jib arm relative to the frame in the directions of the axis of rotation of said cutting tool means, first drive means for pivotally moving said jib arm in said directions, second drive means for rotating said cutting tool means, and means for adjusting the velocity imparted by said first drive means and said second drive means independently of each other.

6. A cutting machine as in claim 5 wherein said first drive means includes a hydraulic cylinder and piston unit and wherein said means for adjusting the velocity imparted to said jib arm by said first drive means includes means for controlling the flow of hydraulic fluid to said cylinder.

7. A cutting machine as in claim 6 wherein said means for controlling the flow of hydraulic fluid includes a controllable reducing valve.

8. A cutting machine as in claim 6 wherein said means for controlling the flow of hydraulic fluid includes a pump having a variable capacity.

9. A cutting machine as in claim 5 wherein said means for adjusting the velocity imparted by said second drive means includes a drive motor and a variable ratio transmission connected between said motor and said cutting tool means.

10. A cutting machine as in claim 9 wherein said transmission includes a hydraulic torque converter.

11. A cutting machine as in claim 9 wherein said transmission includes a gear box with change wheels.

* * * * *